US008105110B2

(12) United States Patent
Hsia et al.

(10) Patent No.: US 8,105,110 B2
(45) Date of Patent: Jan. 31, 2012

(54) CAGE FOR ELECTRICAL CONNECTOR AND CONNECTOR ASSEMBLY USING THE CAGE

(75) Inventors: Chih-Hui Hsia, Chungli Taoyuan (TW); Po Win Wang, Chungli Taoyuan (TW); Chung Hsiang Fu, Chungli Taoyuan (TW)

(73) Assignee: FCI, Guyancourt (FR)

( * ) Notice: Subject to any disclaimer, the term of this patent is extended or adjusted under 35 U.S.C. 154(b) by 0 days.

(21) Appl. No.: 12/737,368

(22) PCT Filed: Jul. 6, 2009

(86) PCT No.: PCT/IB2009/054205

§ 371 (c)(1),
(2), (4) Date: Mar. 15, 2011

(87) PCT Pub. No.: WO2010/004537

PCT Pub. Date: Jan. 14, 2010

(65) Prior Publication Data

US 2011/0159740 A1 Jun. 30, 2011

(30) Foreign Application Priority Data

Jul. 8, 2008 (WO) ..... PCT/IB2008/054050

(51) Int. Cl.
*H01R 13/648* (2006.01)

(52) U.S. Cl. ..... 439/607.01; 439/152

(58) Field of Classification Search ..... 439/152, 439/155, 607.01, 607.05, 607.07, 607.13, 439/607.2, 607.28, 607.35, 607.37, 607.38, 439/607.4, 939

See application file for complete search history.

(56) References Cited

U.S. PATENT DOCUMENTS

| | | | | |
|---|---|---|---|---|
| 6,558,191 | B2 * | 5/2003 | Bright et al. | 439/541.5 |
| 6,558,196 | B2 * | 5/2003 | Festag | 439/607.28 |
| 6,612,868 | B2 * | 9/2003 | Hwang | 439/607.54 |
| 6,893,294 | B2 * | 5/2005 | Moriyama et al. | 439/607.2 |
| 6,926,551 | B1 * | 8/2005 | Schulz et al. | 439/357 |
| 7,727,018 | B2 * | 6/2010 | Bright et al. | 439/607.28 |

FOREIGN PATENT DOCUMENTS

| | | |
|---|---|---|
| JP | 11-008026 | 1/1999 |
| JP | 2001-203026 | 7/2001 |
| JP | 2001-351742 | 12/2001 |
| JP | 2007-005234 | 1/2007 |

* cited by examiner

*Primary Examiner* — Thanh Tam Le
(74) *Attorney, Agent, or Firm* — Harrington & Smith

(57) ABSTRACT

A cage for shielding and handling electrical connectors, the cage has a pair of sidewalls each having a first and second longitudinal portions. A transverse link pierce joins the first longitudinal portions to form a single piece. Support members extend from the sidewalls and disposed in the space between the second longitudinal portions. A portion of the electrical connector is seated onto the support members, with the mounting portions of the contact terminals of the connector exposed. The electrical connector can be carried and positioned onto a PCB during the assembling process, by handling the cage only. The electrical connector is movable relative to the cage along vertical direction when contact terminals are brought into contact with the PCB to ensure the coplanary of contact terminals and PCB circuits. The present invention ensures the positioning accuracy of the connector onto the PCB and eases handling and assembling process.

8 Claims, 7 Drawing Sheets

CAGE FOR ELECTRICAL CONNECTOR AND CONNECTOR ASSEMBLY USING THE CAGE

TECHNICAL FIELD

The present invention relates to a cage that provides shielding for an electrical connector against electromagnetic interference (EMI). In particular, it relates a cage for shielding and handling an electrical connector for assembling to a circuit board. The present invention also relates to an electrical connector assembly using such cage.

BACKGROUND

A cage is used in certain applications to provide shielding function to an electrical connector. Conventionally, a cage and an electrical connector are mounted to a substrate such as a printed circuit board (PCB), by assembling processes separate from that for the connector. Positioning and alignment operations are therefore needed to ensure that the cage and the electrical connector are mounted on the PCB at desired positions and with correct relative positioning relationship. To meet such positioning and alignment requirements, specific tooling and/or assembling and checking steps become necessary, which complicate the whole assembling processes.

It is therefore desirable to provide a cage for both shielding a connector, and ease the process for handling and assembling the connector to a PCB.

SUMMARY OF INVENTION

Disclosed herein are cages for shielding and handling electrical connectors as well as electrical connector assemblies using such types of cages. In one embodiment, a cage has a pair of sidewalls each has a first longitudinal portion and a second longitudinal portion. A transverse link piece, which has a length shorter than the pair of sidewalls, joins the first longitudinal portions of the pair of sidewalls and form the cage a one-piece part. Extending transversely and perpendicularly from the pair of sidewalls there are provided one or more support members disposed in the space between the second longitudinal portions. When assembled to a PCB, the support members and the transverse link piece are brought into contact, and/or mounted to, the PCB.

The electrical connector is seated onto the support members but only a portion of the connector is in touch the support members. The mounting portions of the contact terminals of the connector are exposed to the bottom surface of the transverse link piece through the space. Accordingly, the electrical connector can be lifted, handled, and positioned onto a PCB during the assembling process, by holding the cage only. The support member is structured to allow the electrical connector to move relative to the cage along vertical direction only, hence the contact terminals and PCB circuits can be adjusted to become coplanar. When placing the cage together with the carried electrical connector onto the PCB, the mounting portions of the contact terminals are brought into contact with the PCB first. Further lowering the cage will cause the transverse link piece contacting the PCB and meanwhile, the PCB acts against the mounting portions of the contact terminals, and cause the electrical connector to move upward. By the gravity of the electrical connector, the electrical connector rests onto the PCB and the mounting portions of the contact terminals maintain contact with the PCB. In a subsequent process, both the cage and mounting portions of the contact terminals can be mounted to the PCB by, e.g. a soldering process. Separate positioning and/or alignment process for the electrical connector can therefore be eliminated, and process efficiency can be improved.

In another embodiment, a cage or shield for an electrical connector is provided, both to be mounted onto a printed circuit board (PCB). The cage has a holding structure onto which the connector is seated, an opening at bottom side through which the terminals of the connector are exposed, and a fixing structure to mount to the PCB. The connector is movably attached to the cage, whereby upward and downward movements of the connector relative to the shield are allowed. The holding structure includes a support member at bottom side to prevent the connector from falling off, shifting horizontally or rotation relative to the shield. When to be mounted to the PCB, the connector is attached to the cage and both are placed on the PCB. The terminals are brought into contact with the PCB first, the connector is pushed by the PCB to move upward and further, the fixing structure is brought into contact with the PCB. The terminals remain in contact with the PCB by the gravity of the connector. Both the terminals and the fixing structure can be fixed to the PCB via a single mounting step. A top cover may be provided to enclose the connector to provide further shielding effect on the top side of the connector. The top cover may be mounted to the PCB directly or coupled to the cage.

BRIEF DESCRIPTION OF DRAWINGS

These and other aspects and advantages of the present invention will be described in detail with reference to the accompanying drawings, in which.

DETAILED DESCRIPTION OF THE PREFERRED EMBODIMENTS

Figure 1:
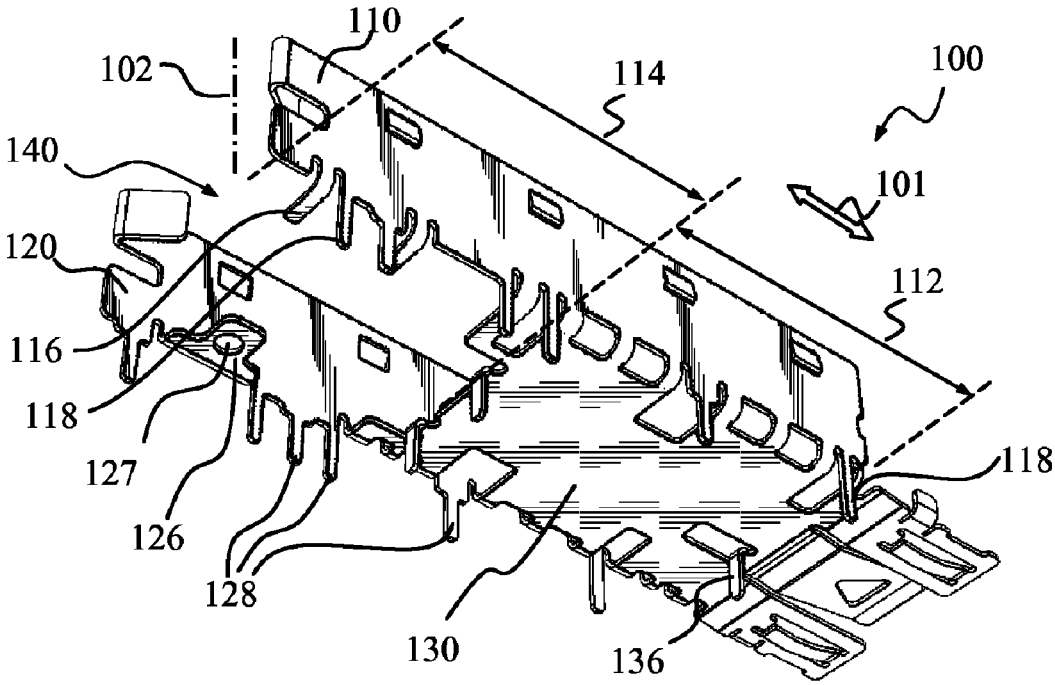
FIG. 1 is a perspective view of a cage for an electrical connector according to one embodiment of the present invention.

As shown in FIG. 1, a cage 100 according to one embodiment of the present invention has a first sidewall 110 and a second sidewall 120 both parallel to a vertical axis 102. Each sidewall has a first and second segment along longitudinal direction 101, hereinafter referred to as first longitudinal portion 112 and a second longitudinal portion 114. A transverse link piece 130 joins first longitudinal portions 112 of first and second sidewalls 110 and 120, forming cage 100 an integral structure. Between second longitudinal portions 114 of first and second wide walls 110 and 120, there is defined a space 140.

Figure 2:
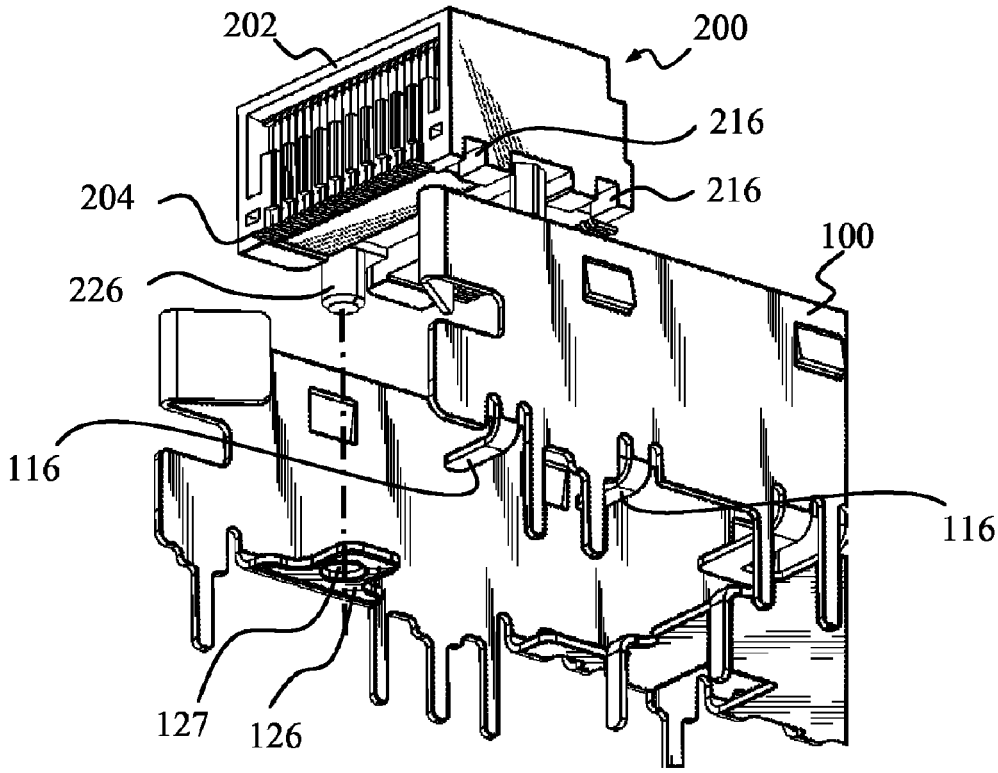
FIG. 2 is a perspective view of FIG. 1 to which an electrical connector is to be assembled to form a connector assembly.

First sidewall 110 has one or more supporting members 116 extending perpendicularly into space 140. Second sidewall 120 has one or more supporting members 126 extending perpendicularly into space 140, and facing supporting members 116. Supporting members 116 and 126 can hold a connector 200 placed between second longitudinal portions 114 of first and second sidewalls 110 and 120, as shown in FIG. 2.

Figure 3:
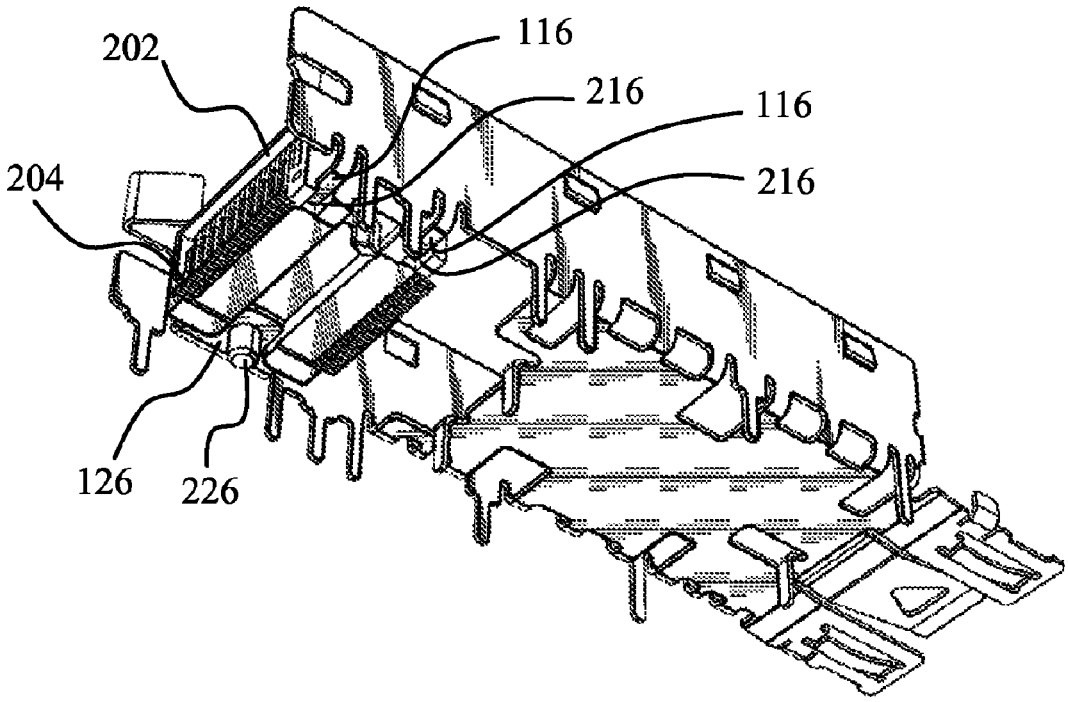
FIG. 3 is a perspective view of FIG. 2 when the electrical connector is carried by the cage.

Depending on the housing structure of connectors to be supported by cage 100, supporting members 116 and 126 may be in the form of cantilevered bars with a free end suspended in space 140 and a fixed end formed integral with sidewalls 110, 120. A through hole 127 may be formed on one or more of the support members as an option. Connector 200 has a housing 202 and contact terminals 204 disposed therein. In one type of exemplary connector, at bottom side of housing 202 there are formed a groove 216 and a post 226. When connector 200 is placed onto cage 100, groove 216 receives a corresponding cantilevered support member 116, and post 226 is inserted into through hole 127 of support member 126. Connector 200 can therefore seat onto supporting members 116 and 126 by its gravity, with contact terminals 204 exposed through space 140, as shown in FIG. 3. The engagement between support members 116, 126 and respective groove 216 and post 226 allows connector 200 to move relative to cage 100 along vertical direction, but restrict connector 100 from shifting along horizontal direction, or rotating relative to cage 100 about vertical axis 102.

The relative position between cage 100 and connector 200 are predefined and the position, dimension and number of supporting members are so structured to ensure relative positioning accuracy between cage 100 and connector 200.

Figure 4:
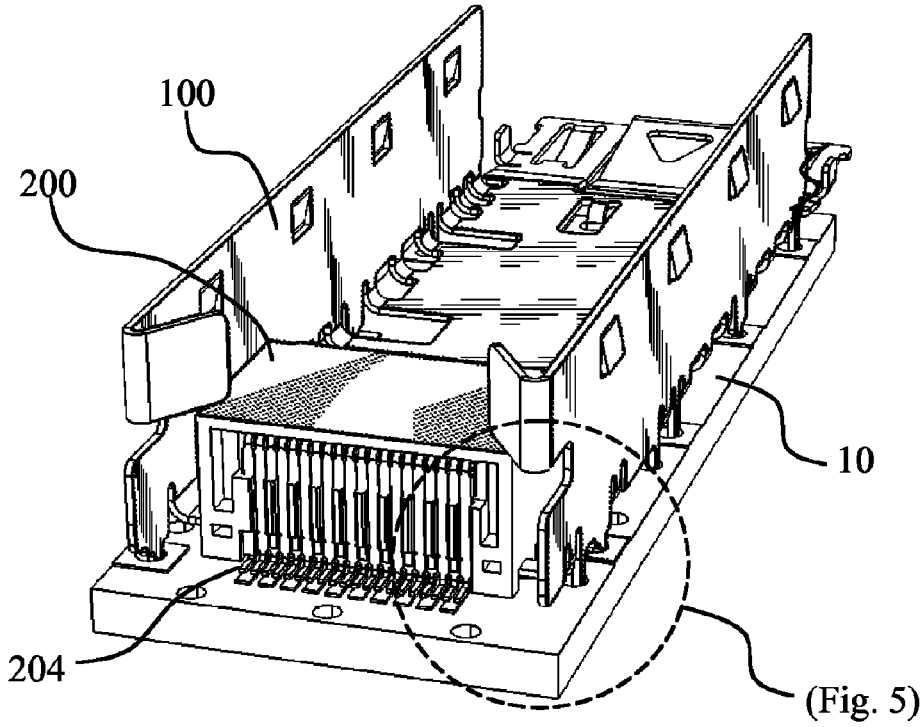
FIG. 4 is a perspective top view of FIG. 3 when placed onto a PCB.
Figure 5:
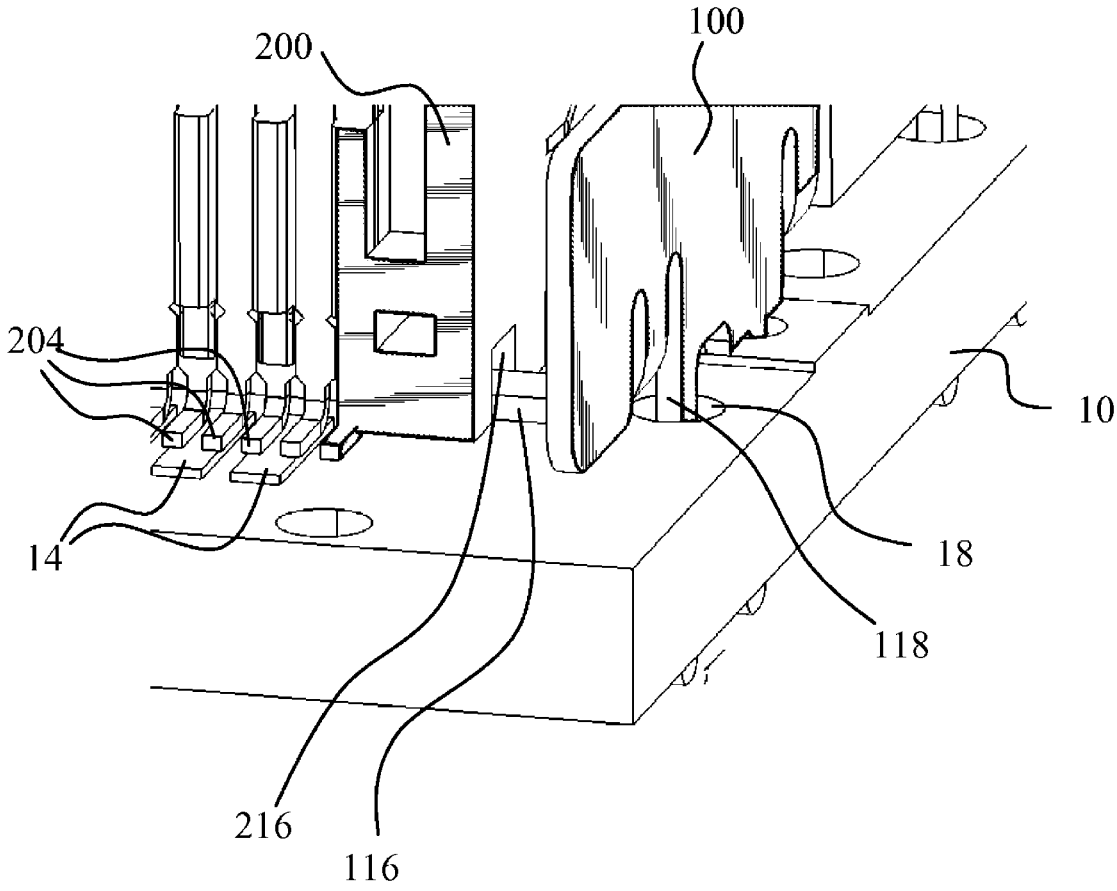
FIG. 5 is a partial enlarged view of FIG. 4.

During the assembling process, cage 100 serves as a carrier to handle and position connector 200. The cage and the connector can be placed and positioned onto a PCB 10 in a single operation step by holding cage 100 only, as shown in FIGS. 4 and 5.

When cage 100 and connector 200 are placed onto PCB 10, mounting tabs 118, 128 formed on first and second sidewalls 110 and 120 and mounting tab 136 on link piece 130 are inserted into through holes 18 of PCB 10, whereby the positional accuracy of cage 100 on PCB 10 is ensured. Contact terminals 204 are then brought into contact with circuits 14 of PCB 10. By further lowering cage 100, link piece 130 will be brought into contact with PCB 10. During the above-mentioned process, as connector 200 is restricted from movement along horizontal direction or rotation relative to cage 100, positional accuracy of connector 200 onto PCB 10 is ensured following the correct positioning of cage 100. Separate operation for positioning and aligning connector 200 is eliminated. In addition, the vertical movement capability allows connector 200 to move freely while maintaining contact with PCB by gravity, and ensure proper contact and coplanar with circuits 14, for subsequent mounting/soldering process. In addition, both contact terminals 204 and link piece 130 can be mounted or soldered onto PCB 10 in a single process step. Production efficiency is further improved.

Figure 6:
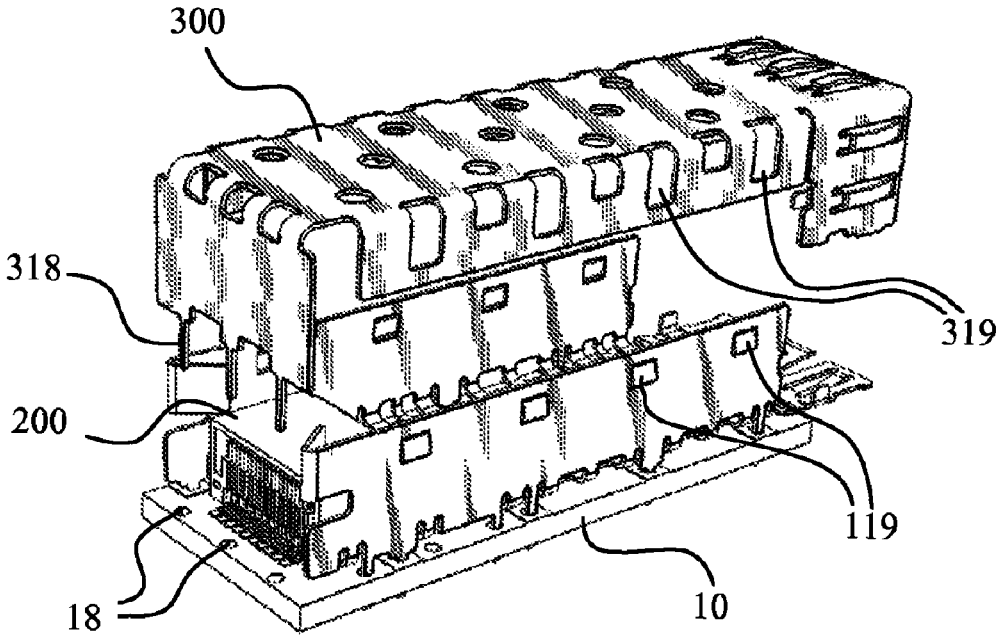
FIG. 6 is a perspective view of FIG. 4 with a top cover.
Figure 7:
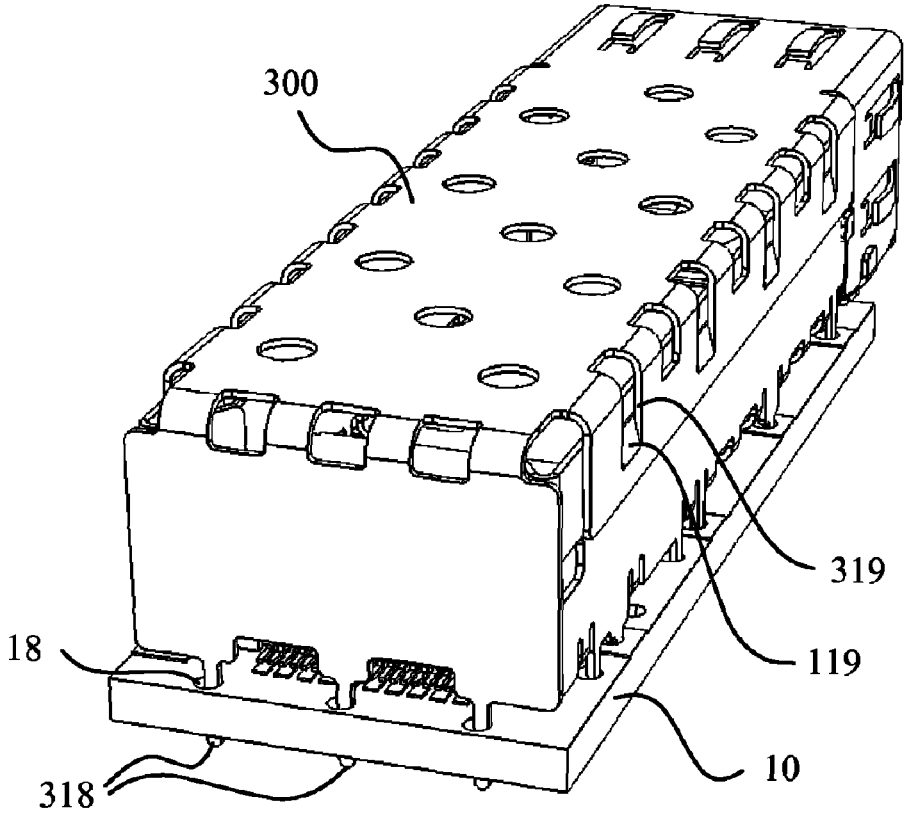
FIG. 7 is a perspective of FIG. 6 with the top cover assembled to the cage.

As shown in FIGS. 6 and 7, a top cover 300 may be provided to cover cage 100, to form a closed shield to enclose connector 200. Top cover 300 has mounting tabs 318 for inserting into respective through holes 18 of PCB 10. Top cover 300 may also have openings 319 for engaging with latch barbs 119 of cage 100. When top cover 300 is placed on covering cage 100, mounting tabs 318 of top cover 300 are inserted into through holes 18. In the meantime, latch barbs 119 snaps into openings 319 to lock cage 100 and top cover 300 together.

Figure 8:
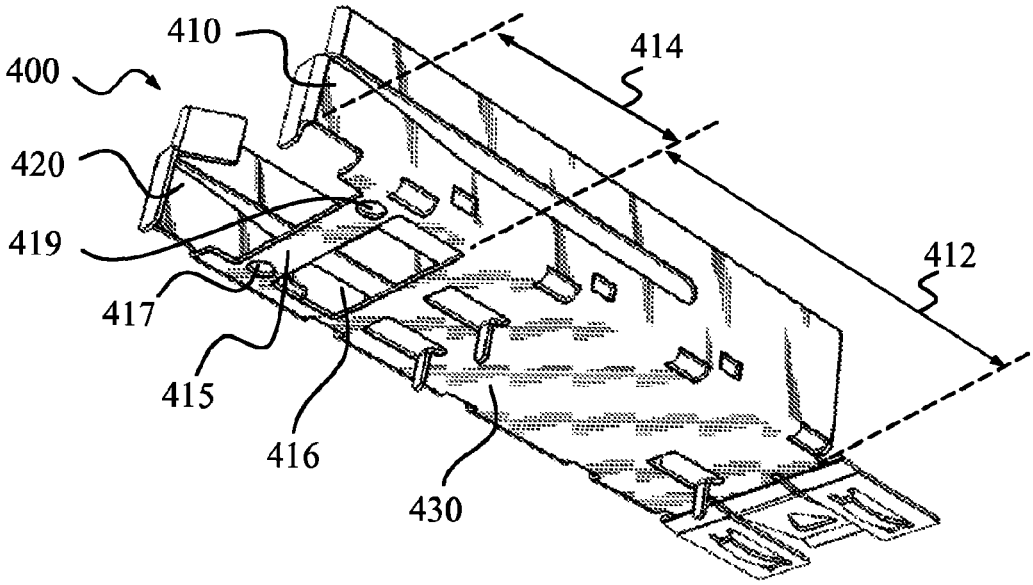
FIG. 8 is a perspective view of a cage according to another embodiment of the present invention.

FIG. 8 shows a cage 400 for handling and shielding a connector 500 according to another embodiment. Cage 400 has first and second sidewalls 410 and 420 connected by a link piece 430 at first longitudinal portion 412. As an alternative to the cantilevered form as seen in the previous embodiment, the support member is in the form of a link bar 415 connecting second longitudinal portions 414 of first and second sidewalls 410 and 420 of cage 400. On link bar 415 there are provided holes 417 and 419, each for receiving a corresponding post 517, 519 formed at bottom surface of connector 500. Link bar 415 has a width less than the whole area of the bottom surface of housing 502. Between link bar 415 and link piece 430 there is formed an opening 416.

Figure 9:
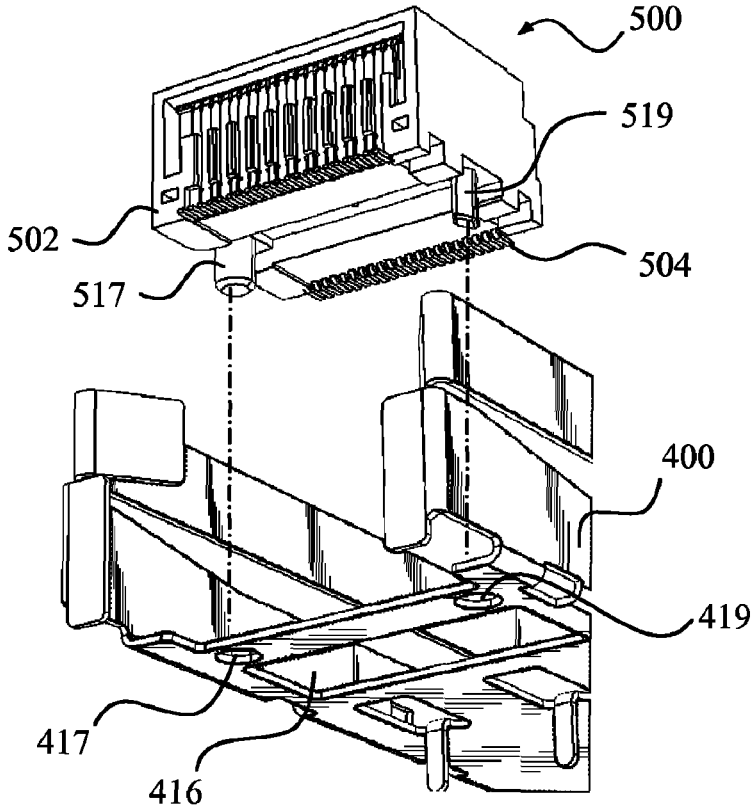
FIG. 9 is a perspective view of FIG. 8 to which an electrical connector is to be assembled to form a connector assembly.
Figure 10:
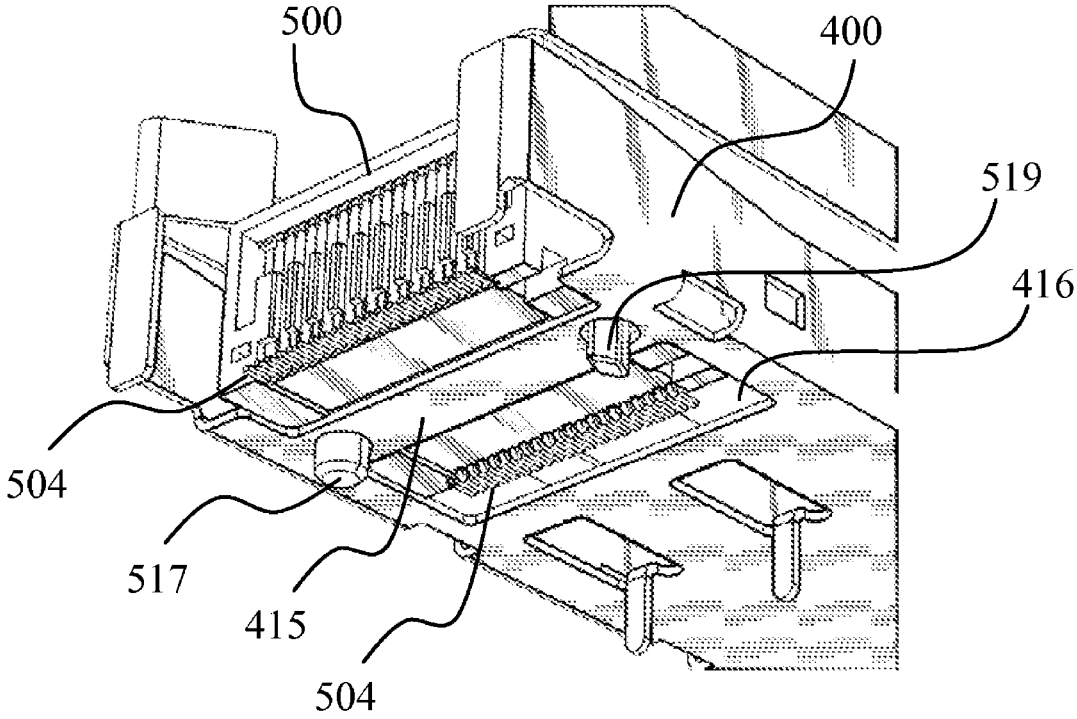
FIG. 10 is a perspective view of FIG. 9 when the electrical connector is carried by the cage.

As shown in FIGS. 9 and 10, similar to the effects of the previous embodiment, when connector 500 is placed onto cage 400, a portion of housing 502 rests on link bar 415, with posts 517 and 519 inserted into respective holes 417 and 419. Connector 500 is therefore held by cage 400 accordingly, and with terminals 504 exposed through opening 416 and facing downward. Cage 400 together with the connector 500 carried thereon can then be placed and assembled onto a PCB (not shown), with desired positioning and alignment accuracy. Connector 500 is allowed to move upward/downward with posts 517, 519 sliding along holes 417, 419, when contact terminals 504 contact the PCB. In the meantime, mounting portions of contact terminals 504 remain contacted with the PCB by the gravity of connector 500. Cage 400 and connector 500 can then be mounted on the PCB in a single mounting step, in a manner similar to that of the previous embodiment.

Figure 11:
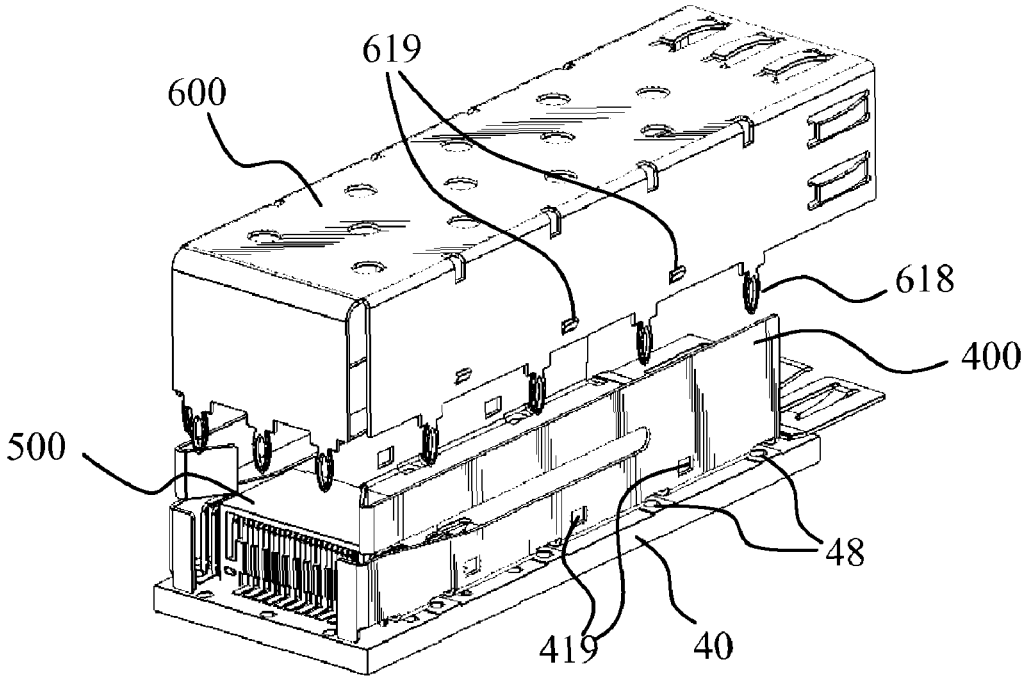
FIG. 11 is a perspective view of FIG. 10 with a top cover.
Figure 12:
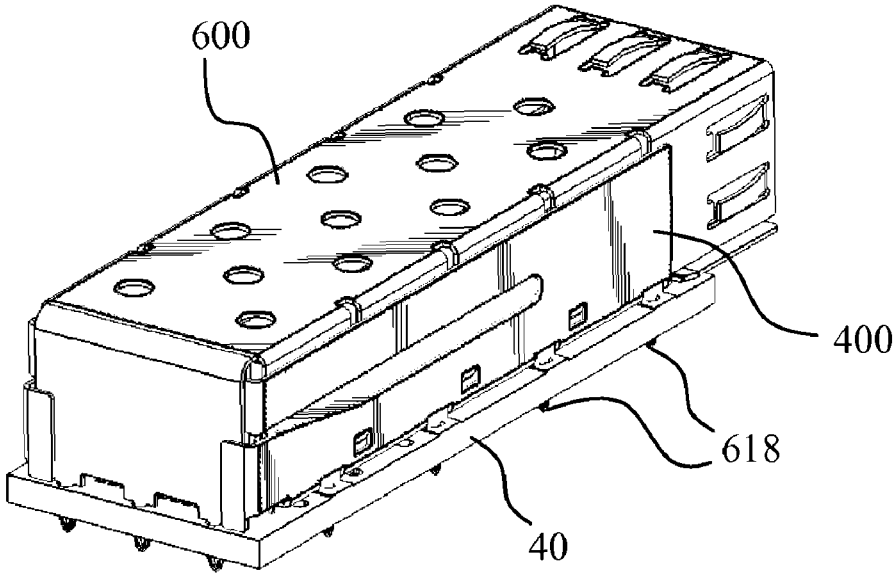
FIG. 12 is a perspective of FIG. 11 with the top cover assembled to the cage.

As shown in FIG. 11, a top cover 600 may be provided to cover cage 400, to form a closed shield to enclose connector 500. Top cover 600 has mounting tabs 618 located at side border thereof for inserting into respective through holes 18 of PCB 40. Top cover 600 may also have latch barbs 619 for engaging with openings 419 of cage 400. When top cover 600 is placed on cage 400, mounting tabs 618 of top cover 600 are inserted into through holes 48 of PCB 40. In the meantime, latch barbs 619 snaps into openings 419 to lock cage 400 and top cover 400 together, as shown in FIG. 12.

The invention claimed is:

1. A cage for an electrical connector, the cage comprising:

a pair of parallel sidewalls each having a first and a second longitudinal portions;

a link piece joining the first longitudinal portions of the pair of sidewalls;

at least one support member extending perpendicularly from one of the sidewalls into a space between the second longitudinal portions;

wherein the at least one support member is to engage a portion of the electrical connector to allow the electrical connector to move in vertical direction and prevent the electrical connector to move in horizontal direction, wherein the at least one support member includes cantilevered bars integrally formed to the sidewalls, wherein at least one of the cantilevered bars has a through hole formed thereon.

2. The cage of claim 1, wherein the at least one support members includes a link bar connecting both the first and the second sidewalls.

3. The cage of claim 1, wherein each sidewall having at least one mounting tab extending downwardly therefrom and parallel to the sidewalls for mounting the cage to a circuit board.

4. The cage of claim 1, wherein the link piece having at least one mounting tab extending downwardly therefrom and perpendicular to the link piece for mounting the cage to a circuit board.

5. The cage of claim 1, further comprising a top cover coupled to the cage to form an enclosure, wherein the top cover having mounting tabs downwardly extending therefrom for mounting the top cover to a circuit board.

6. An electrical connector assembly comprising:

an electrical connector including a housing and a least one groove formed at a bottom surface of the housing;

a plurality of contact terminals disposed in the housing, each contact terminal having a mounting end extending beyond the bottom surface of the housing, a cage for an electrical connector, the cage comprising:

a pair of parallel sidewalls each having a first and a second longitudinal portions;

a link piece joining the first longitudinal portions of the pair of sidewalls;

at least one support member extending perpendicularly from one of the sidewalls into a space between the second longitudinal portions;

wherein the at least one support member is to engage a portion of the electrical connector to allow the electrical connector to move in vertical direction and prevent the electrical connector to move in horizontal direction, wherein the at least one supporting members is received in the at least one groove of the housing such that relative movement between the connector and the cage along vertical direction is allowed and relative movement between the connector and the cage along horizontal direction is prevented.

7. The electrical connector assembly of claim 6, wherein the electrical connector having at least one post formed at the bottom surface of the housing, the at least one supporting member has at least one through hole in which the at least one post is received.

8. The electrical connector assembly of claim 6, wherein the at least one support member includes a link bar connecting both the first and the second sidewalls and form an opening between the link bar and the link piece, wherein the mounting ends of the contact terminals extend through the opening.

* * * * *